United States Patent [19]

Nguyen

[11] Patent Number: 4,553,830

[45] Date of Patent: Nov. 19, 1985

[54] SERVICING SYSTEM FOR REPRODUCTION MACHINES

[75] Inventor: Tuan A. Nguyen, Webster, N.Y.

[73] Assignee: Xerox Corporation, Stamford, Conn.

[21] Appl. No.: 526,925

[22] Filed: Aug. 26, 1983

[51] Int. Cl.[4] ..... G03G 21/00

[52] U.S. Cl. ..... 355/14 R; 355/14 C

[58] Field of Search ..... 355/3 R, 14 R, 14 C, 355/14 E, 133

[56] References Cited

U.S. PATENT DOCUMENTS

| | | | |
|---|---|---|---|
| 3,673,936 | 7/1972 | Stone, Jr. et al. | 95/12 |
| 3,936,180 | 2/1976 | Willard et al. | 355/14 |
| 4,035,072 | 7/1977 | Deetz et al. | 355/14 |
| 4,156,133 | 5/1979 | Legg | 235/92 SB |
| 4,162,396 | 7/1979 | Howard et al. | 355/14 C X |
| 4,181,429 | 1/1980 | Batchelor et al. | 355/77 |
| 4,186,299 | 1/1980 | Batchelor | 235/304.1 |
| 4,206,995 | 6/1980 | Legg | 355/14 C |
| 4,247,193 | 1/1981 | Kaneko et al. | 355/14 R |

FOREIGN PATENT DOCUMENTS

| | | | |
|---|---|---|---|
| 990118 | 6/1976 | Canada | 95/31 |

*Primary Examiner*—Fred L. Braun

*Attorney, Agent, or Firm*—Frederick E. McMullen

[57] ABSTRACT

To facilitate servicing of xerographic type reproduction machines or printers, diagnostic routines are used (1) to operate the machine in a predetermined copy run while recording the clock count on a global counter on the arrival of a copy sheet at a first selected jam station in the paper path and the count on arrival of the same copy sheet at the next jam station, and then display the clock count difference on the machine display console for comparison by the Tech Rep with a master clock count; (2) to operate the machine in a present copy run while fetching the current timing parameter of a machine subassembly from memory, displaying the timing parameter to the Tech Rep on the machine display console, and permitting the Tech Rep to use the machine control panel keyboard to reset the timing parameter while watching the effect of the timing change on the copies as they are produced; and (3) to delay the arrival of the copy sheet at the machine image transfer station so that the normally unprinted interdocument area wherein process control images are formed is printed out to enable the process control images to be visually examined.

6 Claims, 12 Drawing Figures

MAIN MEMORY BOARD
NVM
7
61
CONTROL PANEL
6
114
CENTRAL PROCESSING MASTER (CPM)
19
SCHEDULER
59
RAM
63
MACHINE CLOCK
45
PAPER HANDLING REMOTE (PHR)
11
PITCH RESET SIGNAL
46
47
32
25
13
MARKING & IMAGING REMOTE (MIR)
GLOBAL COUNTER
43
110
XEROGRAPHIC REMOTE (XER)
15
SHARED LINE BUS
RECIRCULATING DOCUMENT HANDLER (RDHR)
17
SORTER REMOTE (SOR)
9
DISPLAY CONSOLE REMOTE
125

COPY INFORMATION BYTE

64

| FEED / NO FEED | PURGE | ENDSET | INVERT | DESTINATION | | SOURCE | |
|---|---|---|---|---|---|---|---|
| X | X | X | X | X | X | X | X |

SERVICING SYSTEM FOR REPRODUCTION MACHINES

The invention relates to a reproduction machine, and more particularly, to a system for diagnosing, servicing, and adjusting the various operating components, subassemblies, and modules of a reproduction machine.

The high degree of complexity attending modern day reproduction machines, copiers, printers, and the like, particularly in the case of high speed full featured versions of these machines, complicates the detection and identification of problems and repair and service. This is particularly true where machine timing is under scrutiny for the purpose of detecting timing errors and making the requisite adjustments to bring the machine operating timing into design specifications. For as can be understood, the various operating components and subassemblies of the machine must be timed to within extremely close tolerances if the machine is to operate as designed, or even to operate at all. In this context, matters are complicated even further by the fact that any slight deviation in or adjustment to the timing parameter of one component or subassembly can have a ripple effect in the sense that the timing of other components and subassemblies are affected and hence may require compensating adjustment if proper machine operation is to be maintained. For example, in many machines, the paper path is effectively segregated into a succession of sections, an arrangement which the art has found useful for paper jam detecting purposes particularly. However, this necessitates that the timing of a copy sheet as it moves from one paper path section to another be held within close tolerances if an operative paper path is to be established without causing the paper jam detectors to perceive the presence of a jam due to premature or delayed arrival of the copy sheet at one detector.

As a further aspect, machines of the type alluded to usually incorporate internal controls, many of which are highly sophisticated, to monitor the operating state of different machine components and subassemblies. Controls of this type serve to automatically adjust the operating parameters of the components or subassemblies being monitored to maintain copy quality without the need to invoke a service call with consequent machine down time.

One control for example responds to the operating state of the machine xerographic processing system such as the toner dispenser for resupplying toner as it is used up. Typically, a control of this type utilizes a series of test images, which are produced from time to time on the machine photoconductor as determinative of the operating state of the machine's xerographic processing system. Of course, to avoid contaminating the copies being produced, the test images are produced on unused areas of the machine photoconductor. This means however that the test images cannot be seen and examined by the machine service personnel either since the test images are not printed out. Yet, it would be advantageous to nevertheless make the actual test images available for inspection by the service personnel; this on the basis that if the test images themselves are deficient, the true problem may not be recognized but instead the machine control will think erroneously that the fault is due to misadjustment or malfunction of the xerographic processing components and will make unneeded and potentially harmful adjustments to the xerographic processing components.

The present invention seeks to alleviate the foregoing problems and deficiencies by providing a servicing-/diagnostic process for a reproduction machine, comprising the steps of: operating the machine copy programming means to program the machine for a predetermined service routine for determining the time interval between two selected points along the path followed by the copy sheets or document originals during a copy run; actuating the machine; recording the count on the machine clock on detection of a copy sheet or document original at the first of the two points along the path; recording the count on the clock on detection of the copy sheet or document original at the second of the two points along the path; differencing the clock counts obtained from one another; and displaying the clock count difference on the machine copy run display panel to enable comparison with a standard control count.

The invention further provides a method for timing the discrete operating elements of a reproduction machine to provide optimum copy quality, comprising the steps of: using the machine copy run programmer, inputting a preset service routine for displaying on the machine copy run display panel the current timing parameter of a selected one of the machine operating elements while concurrently programming the machine for a preset copy test run; operating the machine to produce test copies; viewing the test copies produced by the machine and adjusting the timing parameter of the selected operating element; and repeating the above until the timing parameter of the selected operating element is adjusted to provide the desired copy quality.

IN THE DRAWINGS

Figure 1:
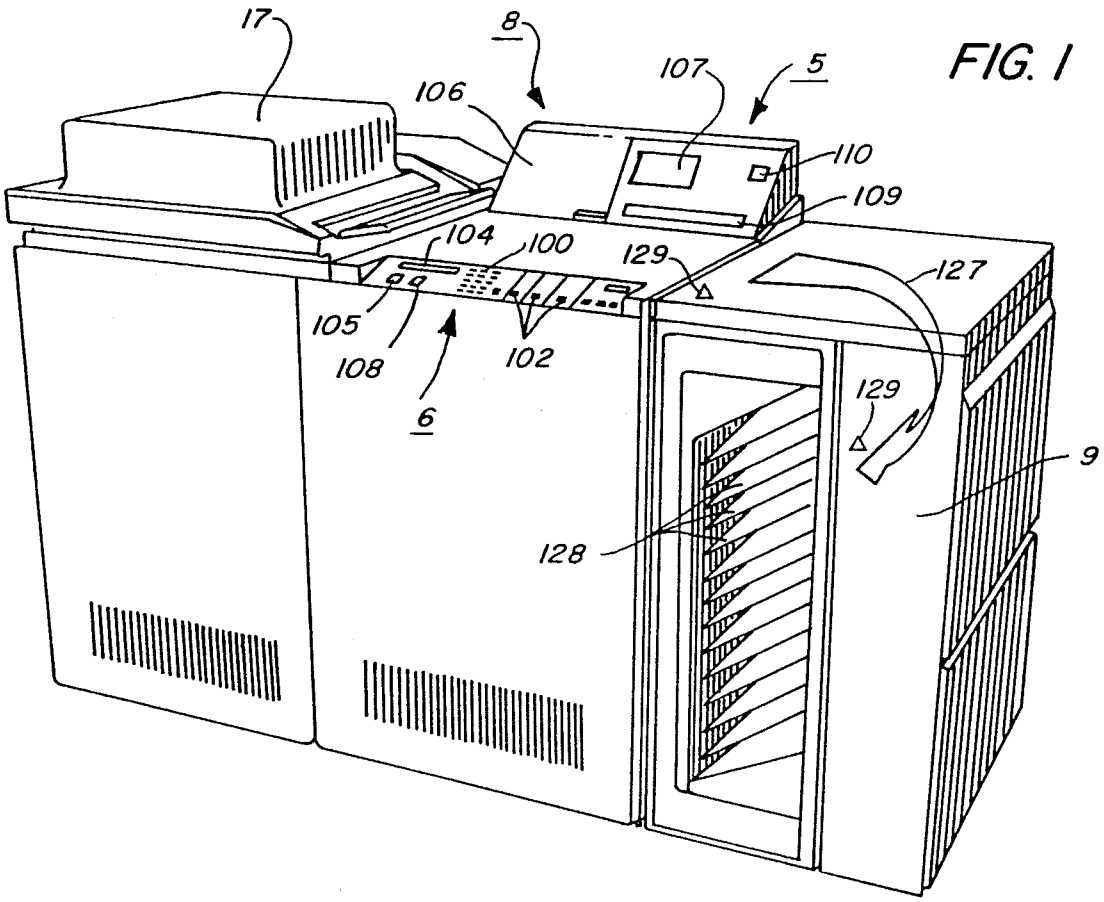
FIG. 1 is an isometric view of an electrographic reproduction machine of the type adapted for use with the present invention.

While the present invention will hereinafter be described in connection with a preferred embodiment thereof, it wll be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings. In the drawings, like reference numerals have been used throughout to designate identical elements. FIGS. 1–4 schematically depict the various components of an illustrative electrophotographic reproduction or printing machine 5 incorporating the servicing system of the present invention therein. As will appear, machine 5 includes an automatic document handler, referred to herein as RDHR 17, and a sorter output module referred to herein as SOR 9. It will become evident from the following discussion that the invention is equally well suited for use in a wide variety of printing machines and is not necessarily limited in its application to the particular embodiment shown herein.

A control panel 6 allows the use or operator to select copy size, copy contrast, number of copies to be made, the manner (duplex, for example) in which the copies are to be made, etc. Panel 6 includes programming means in the form of a numeric keyboard 100 ordinarily used by the operator for programming in the number of copies to be made, a plurality of additional selection buttons 102 for programming in various operating features such as duplex copying, auxiliary paper tray, etc., and a multi-digit (i.e. eight) numeric display array 104 for displaying to the operator or user, and as will appear, to the machine service personnel, the number programmed by keyboard 100. A Start/Print button 105 is provided on control panel 6 for starting up the machine and a job interrupt (VIP) button 108 to permit the operator or user to interrupt the job or copy run in progress to run a different job and thereafter return to the interrupted job. Actuation of job interrupt button 108 changes the operating state of reproduction machine from "Level 1" to "Level 2".

A display panel 8 informs the user of the status of the reproduction machine 5 and can be used to prompt the operator to take corrective action in the event of a machine fault. In the example shown, display panel 8 includes a flip chart 106, a Liquid Crystal Display (LCD) 107, an alphanumeric display 109, and a "Power On" button 110. As may be understood, LCD display 107 cooperates with alphanumeric display 109 to inform the user of the machine operating status, to identify faults as they occur, and to refer the operator to flip chart 106 in the event the instructions to be given are more complex than can be conveniently displayed by the LCD and alphanumeric displays 107, 109.

In addition, and as will appear more fully hereinafter, the machine service man, commonly referred to as the Tech Rep, uses both control panel 6 and display panel 8 to input various diagnostic programs for checking the operating condition of the different machine components.

Inasmuch as the art of electrophotographic printing is well known, the various processing stations employed in the printing machine 5 will be shown hereinafter schematically and their operation described briefly with reference thereto.

The illustrative electrophotographic printing machine 5 employs a belt 10 having a photoconductive surface thereon. Preferably, the photoconductive surface is made from a selenium alloy. Belt 10 is driven by main drive motor 29 and moves in the direction of arrow 12 to advance successive portions of the photoconductive surface through the various processing stations disposed about the path of movement thereof. In the example shown, the ends of belt 10 are butted together at seam 10' to provide an endless belt.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, (referred to herein as recirculating document handler remote or RDHR 17), positions original documents 16 facedown over exposure system 23. The exposure system, indicated generally by reference numeral 23 includes an exposure means in the form of flash lamp 20 which illuminates the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10. While a light/lens type exposure system is illustrated herein, other exposure systems such as scanning laser may be envisioned.

RDHR 17 sequentially feeds documents 16 from a stack of documents placed by the operator in a normal forward collated order in a document stacking and holding tray 17' to platen 18. Following copying, RDHR 17 recirculates the documents back to the stack supported on the tray 17'. For this purpose, suitable document guides 120 and cooperating transport rollers and belts 124 cooperate to form a document path 122 leading from tray 17' to platen 18 and from platen 18 back to tray 17'. Suitable document sensors 125 are provided at discrete points along the document path 122 for detecting the presence or absence of a document at predetermined times during the document feeding cycle. Preferably, RDHR 17 is adapted to feed documents of various sizes and weights of paper or plastic containing the information to be copied. Preferably, magnification of the imaging system is adjusted to insure that the indicia or information contained on the original document is reproduced within the space of the copy sheet.

While a recirculating document handling unit has been described, one skilled in the art will appreciate that other document handler types may be used instead or that the original document may be manually placed on the platen rather than by the document handling unit. This is required for a printing machine which does not include a document handling unit.

A plurality of sheet transports comprising a vertical transport 31, a registration transport 32, prefuser transport 33, decurler 34, post fuser transport 35, output transport 36, bypass transport 37, and inverter roll 38, cooperate with suitable sheet guides 39 to form a paper path through which the copy sheets 21 being processed pass from either main paper supply tray 27, or auxiliary paper supply tray 27', or duplex paper supply tray 60 through the machine 5 to either top tray 54 or discharge path 58. Transports 31, 32, 33, 34, 35, 36, 37, 38 are suitably driven by main drive motor 29. Suitable sheet sensors designated here by the numeral 41, are provided at the output of each paper tray 27, 27' and duplex tray 60 to detect feeding of a sheet therefrom.

In the exemplary arrangement shown, discharge path 58 communicates with a sorter module (SOR) 9 which provides, as will be understood by those skilled in the art, a paper path 127 leading to a plurality of bins 128. Suitable copy sheet sensors 129 are provided at discrete points along the paper path 127 to detect the presence or absence of a copy sheet at predetermined times during sorting. While a sorter is illustrated as the output module herein, other output modules such as a stitcher may be contemplated. Further, the output module may be dispensed with an output tray used instead.

With continued reference to FIGS. 1–4, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into transfer relation with the toner powder image. Transfer station D includes a corona generating device 30 which sprays ions onto the backside of the copy sheet. This attracts the toner powder image from the photoconductive surface of belt 10 to the sheet. After transfer, prefuser transport 33 advances the sheet to fusing station E.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, decurler 34 and post fuser transport 35 carry the sheets to inverter gate 48 which functions as an inverter selector. When energized or pulled, gate 48 directs the copy sheets into a sheet inverter 50. When inoperative, gate 48 bypasses sheet inverter 50 and the sheets are fed directly to bypass gate 52. Thus, copy sheets which bypass inverter 50 turn a 90° corner in the paper path before reaching gate 52. Bypass gate 52 directs the sheets into top tray 54 so that the imaged side which has been transferred and fused is faceup. If inverter 50 is selected, the opposite is true, i.e. the last printed face is facedown. Bypass gate 52 normally directs the sheet into top tray 54 or, when energized, to bypass transport 37 which carries the sheet to duplex gate 56. Gate 56 either directs the sheets without inversion to the discharge path 58 and SOR 9 or, when energized, to duplex inverter roll 38. Inverter roll 38 inverts and directs the sheets to be duplexed into duplex tray 60. Duplex tray 60 provides intermediate or buffer storage for those sheets which have been printed on one side and on which an image will be subsequently printed on the side opposed thereto, i.e. the copy sheets being duplexed. Due to the sheet inverting action of inverter roll 38, the buffer set of sheets are stacked in duplex tray 60 facedown in the order in which the sheets have been copied.

In order to complete duplex copying, the previously simplexed sheets in tray 60 are fed seriatim by bottom feeder 62 back via vertical transport 31 and registration transport 32 to transfer station D for transfer of the toner powder image to the opposed side of the sheet. Inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to the selected output for subsequent removal by the printing machine operator.

Figure 4:
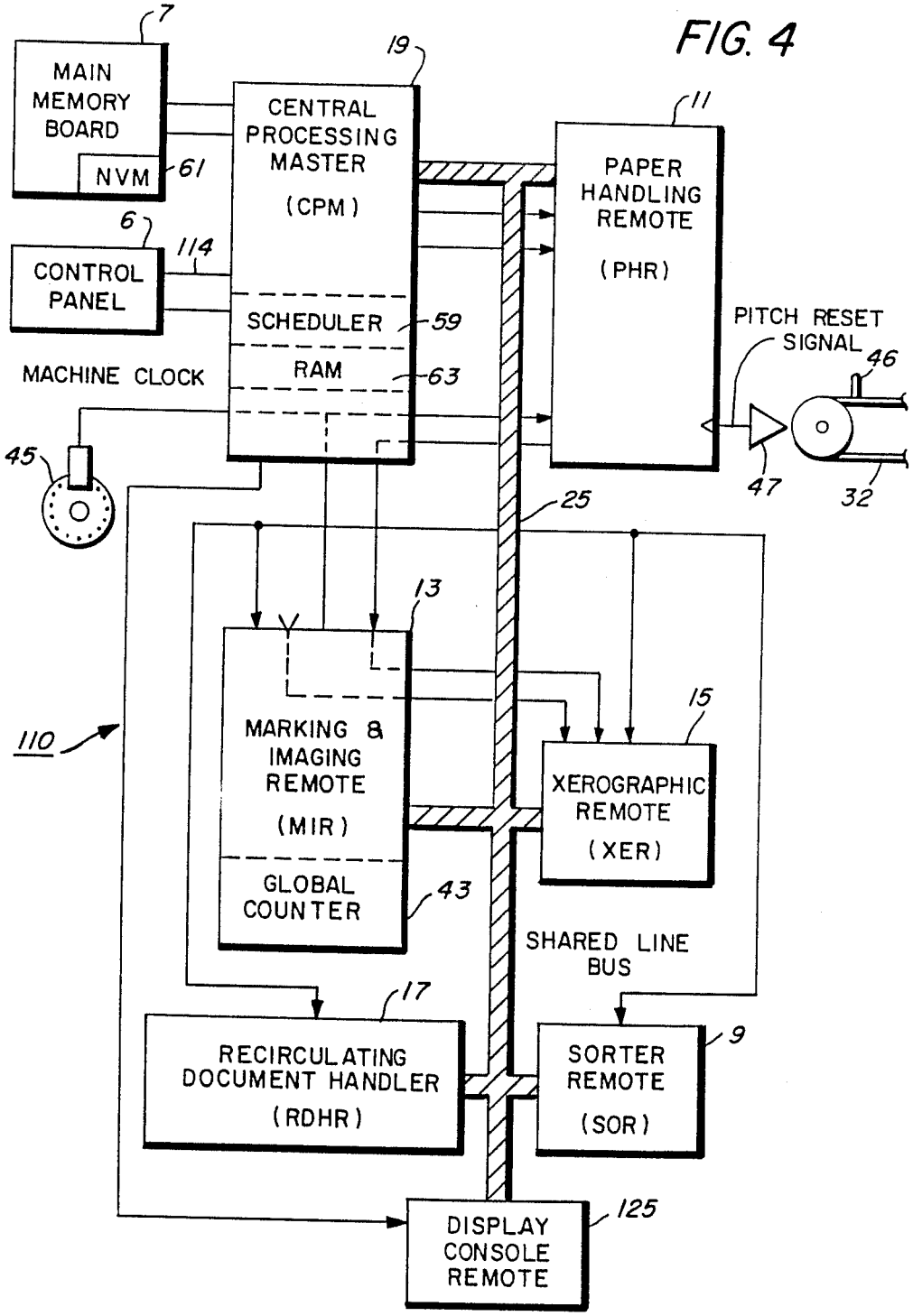
FIG. 4 is a schematic view illustrating the control subdivisions and communication channel for the machine shown in FIG. 1.

Referring particularly to FIGS. 1 and 4, reproduction machine 5 is segregated into a series of independent modules (termed remotes herein), and identified as sorter output remote (SOR) 9, paper handling remote (PHR) 11, marking and imaging remote (MIR) 13, xerographic remote (XER) 15, recirculating document handler remote (RDHR) 17, and central processing master (CPM) 19. SOR 9, PHR 11, MIR 13, XER 15, RDHR 17, and CPM 19 are communicated with one another by means of a shared communication line (SCL) 25 through which controlled instructions and synchronizing clock pulse signals from and to the machine remotes pass.

A suitable machine clock pulse generator 45, which is drivingly coupled to the output shaft of main drive motor 29, generates a succession of clock pulses whenever driver motor 29 is energized. The clock pulse output of clock generator 45 serves to provide timing signals for various components of reproduction machine 5 and for operating a global counter 43. As will be understood, to enhance copy throughout, several copy sheets may be in process at various locations along the paper path at any one time. To accommodate this and permit individual copies to be tracked and processed in the particular manner desired, timing control over the copy processing functions is divided into pitches, each pitch being further subdivided into a number of machine clock pulses. For example, the paper path may be separated into eleven pitches with each pitch being composed of approximately 850 machine clock pulses.

Pitch reset signals, which serve in effect to determine the length of the pitch and the number of machine clock pulses within the pitch, are derived from copy sheet registration finger 46 on registration transport 32. For this purpose, a sensor such as switch 47 is disposed in the path of movement of copy sheet registration fingers 46 such that on each cycle of finger 46 past switch 47, switch 47 outputs a reset signal. The output of machine clock pulses by generator 45 are input through CPM 19 to PHR 11 while the pitch reset signals generated by switch 47 are input directly to PHR 11.

To monitor and control movement and processing of the copy sheets moving along the paper path, a series of sensors which may for example comprise switches, are disposed at predetermined jam detection stations along the paper path. More specifically, a pretransfer jam detection station 49 is provided upstream of transfer station D having sheet sensor 49', a pre-fuser jam detection station 51 is provided upstream of fusing station E having sheet sensor 51', a post-fuser jam detection station 53 is provided on the downstream side of fusing station E having sheet sensor 53', an output transport jam detection station 55 is provided at the inlet to output transport 36 having sheet sensor 55', and a bypass jam detection station 57 is provided in the bypass transport 37 upstream of duplex inverter roll 38 having sheet sensor 57'.

CPM 19 includes a scheduler 59 for scheduling processing of each copy, the copy run instructions programmed through control panel 6 being input to scheduler 59. As will be understood by those skilled in the art, there is also provided a suitable memory section, exemplified herein by Main Memory Band (MMB) 7 (shown in FIG. 3). MMB 7 normally includes both Read Only Memory (ROM) and Random Access Memory (RAM), and nonvolatile memory or NVM 61 wherein data representing the particular machine configuration parameters (i.e. document handler type) and operating parameters (i.e. exposure timing) is stored. Additionally, CPM 19 includes on-board memory such as RAM memory 63. Scheduler 59 responds to the copy run information input by the operator through control panel 6 and the machine configuration and operating parameters input from NVM 61 to generate a copy information byte 64 (shown in FIG. 5) for each copy to be made.

In the exemplary arrangement shown, copy information byte 64 contains data identifying the copy sheet source (i.e. tray 27, 27' or 60), the copy destination (i.e. top tray 54, SOR 9, or duplex tray 60), whether the copy is to be inverted or not (i.e. by inverter 50), whether the copy represents the end of the set (i.e. the last copy of a batch), if the sheet is a clearing or purge sheet (normally as a result of a paper jam), and image information related to the particular copy being made (i.e. feed or not feed a sheet). The copy information byte is entered in RAM 63 and held in a suitable memory location or variable, the latter being defined herein as a location in memory where information is stored. The copy information byte 64 is moved from memory variable to memory variable in synchronism with movement of the copy sheet along the paper path from jam detection station to jam detection station (i.e. from pretransfer jam detection station 49 to prefuser jam detection station 51, from prefuser jam detection station 51 to post fuser jam detection station 53, etc.). In effect, jam detection stations 49, 51, 53, 55 and 57 serve to pass the copy information byte 64 from memory variable to memory variable. At each memory variable, corresponding to a jam detection station, the copy information byte is read to provide operating instructions for the copier components up to the next jam detection station.

Figure 6:
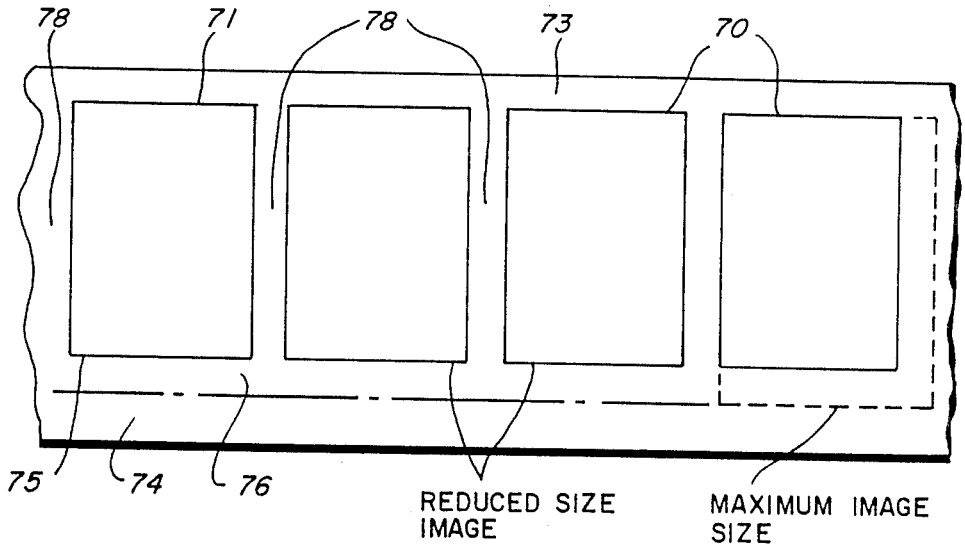
FIG. 6 is an enlarged schematic view of a segment of the machine photoconductive belt illustrating the disposition of images thereon.

Referring now to FIG. 6, it will be understood that where for example multiple copies of a document page are being made, a series of spaced latent electrostatic images 70 are created through exposure of the document 16 on platen 18 to the moving photoreceptor belt 10. Preferably, RDHR 17 registers the document 16 in predetermined position on platen 18, normally in one corner thereof. Where RDHR 17 is not used, the operator or user is instructed to place the document in registered position on platen 18. In the exemplary arrangement shown, this results in one edge (identified herein for convenience as the top 71 of the latent electrostatic image 70) being fixed in position on photoreceptor belt 10 whatever the image size. Accordingly, an undischarged non-image area, referred to as photoreceptor top edge 73 herein, exists between image top 71 and the edge of belt 10 as well as a second undischarged non-image area, referred to as photoreceptor bottom edge 74 herein, between the bottom 75 of the maximum size image 70 and the opposite edge of belt 10. Further, where the document page being copied is smaller in width than platen 18 (the example shown in FIG. 6), an additional non-image area 76 occurs between the photoreceptor bottom edge 74 and the bottom 75 of the latent image 70.

Additionally, there are undischarged non-image areas before the first image, between successive images, and after the last image. For explanation purposes, these areas are collectively referred to and identified herein as interdocument areas 78. Top and bottom edges 73, 74 and any nonimage area 76 are discharged to prevent unwanted development thereof. The interdocument areas 78 are similarly discharged except for the area where test or control patches are made as will appear.

Figure 2:
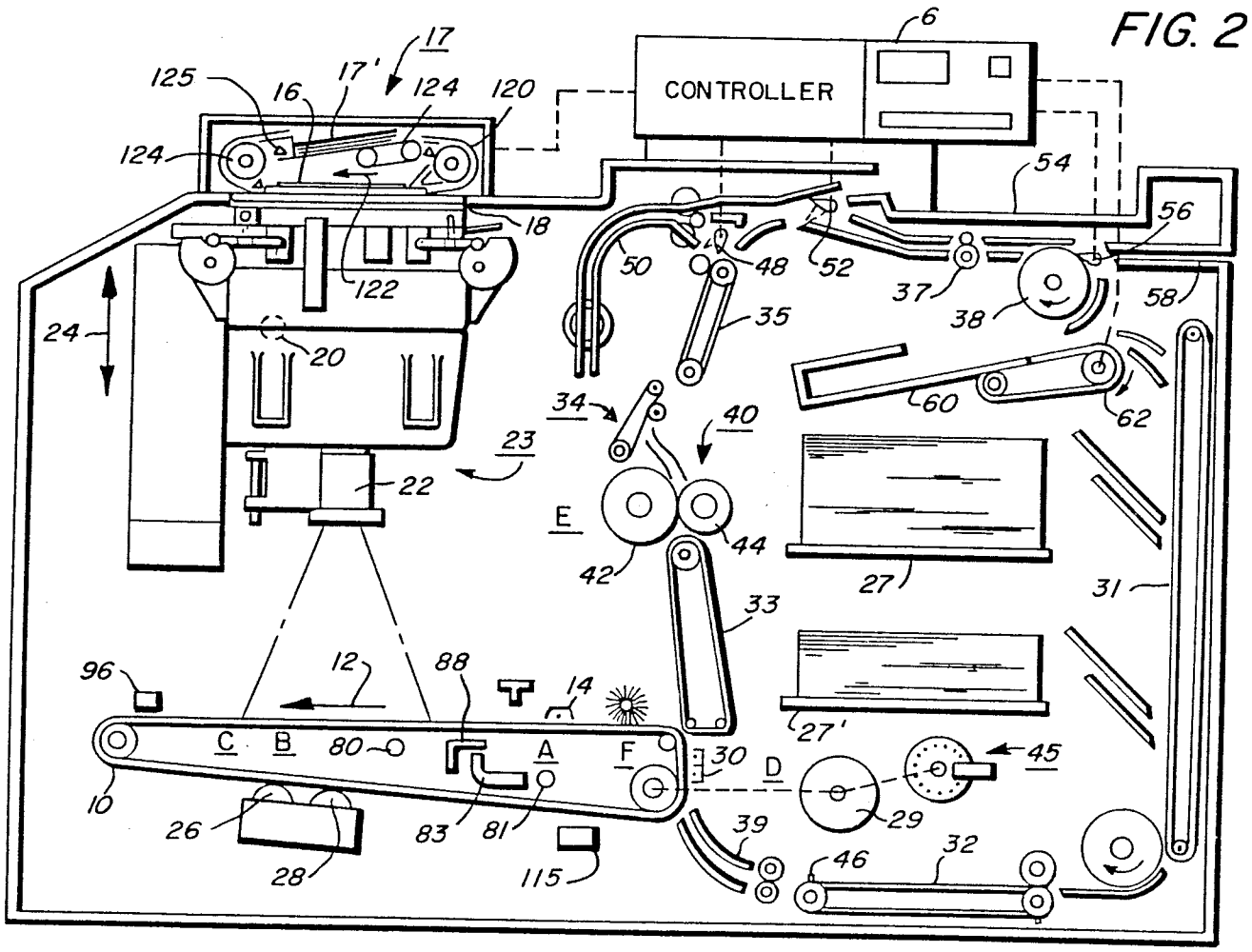
FIG. 2 is a schematic side view in partial cross section showing construction details of the machine shown in FIG. 1.
Figure 3:
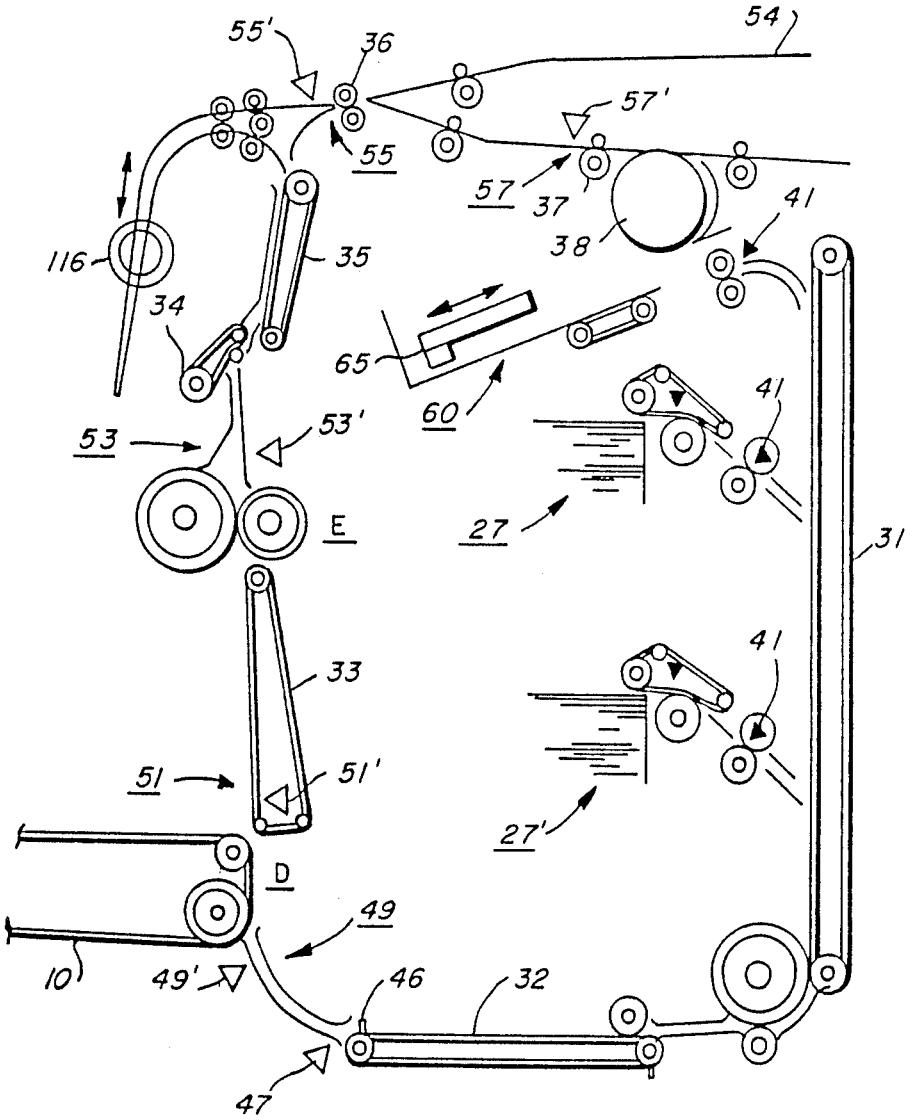
FIG. 3 is a schematic illustration of the paper path with attendant jam detection stations for the machine shown in FIG. 1.
Figure 7:
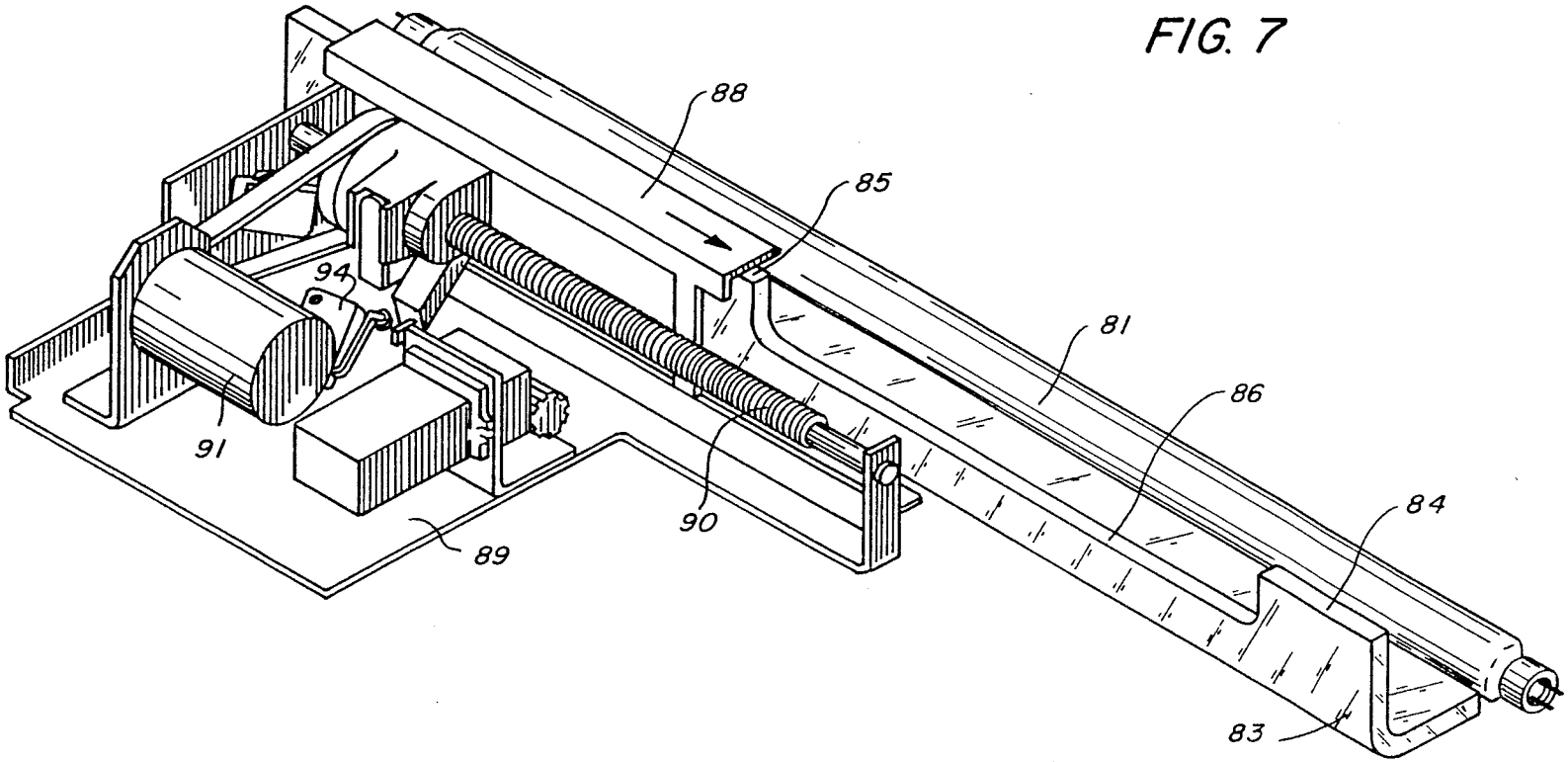
FIG. 7 is an enlarged isometric view showing details of the adjustable edge fade out shutter assembly for the machine shown in FIG. 1.

Referring to FIGS. 2 and 7, to erase or discharge the interdocument area 78, top and bottom edges 73, 74, and in certain cases the nonimage area 76, interdocument and edge erase lamps 80, 81 are provided in the interior of the photoconductive belt 10. Interdocument erase lamp 80, the axial length of which is at least equal to the width of belt 10, is mounted at right angles to the direction of movement of the belt 10 facing the inside surface of belt 10. As will be understood by those skilled in the xerographic arts, operation of interdocument erase lamp 80 is synchronized with movement of belt 10, lamp 80 being energized during periods when there is no image present on belt 10 and being deenergized when an image is present.

Edge erase lamp 81 is suitably supported within belt 10 with the axis of lamp 81 at right angles to the direction of movement of belt 10. The axial length of edge erase lamp 81 is at least equal to the width of belt 10. A plate-like light pipe 83 having a generally U-shape is optically coupled between edge erase lamp 81 and the interior surface of photoreceptor belt 10. The light discharge end of light pipe 83 facing belt 10 has top and bottom edge erase segments 84, 85 and a central non-erase segment 86. Top edge erase segment 84 of light pipe 83 has an axial length equal to the width of the photoreceptor top edge 73 which, where a fixed registration point for document 61 is provided as in the example discussed, remains substantially constant whatever the size image 70 being reproduced. Bottom edge erase segment 85 of light pipe 83 has an axial length equal to the sum of the photoreceptor bottom edge 74 plus the width of the largest size non-image area 76 to be erased.

To enable the effective size of the bottom edge erase segment 85 of light pipe 83 to be adjusted in accordance with the size of the non-image area 76 (it is understood that the size of the non-image area 76 changes with changes in the size of the image 70), an adjustable shutter 88 is interposed between the discharge side of light pipe 83 and belt 10. Shutter 88 is supported in housing 89 with a drive screw 90 coupled thereto to move shutter 88 back and forth upon rotation of drive screw 90. A suitable driving motor such as servo motor 91 is provided to rotate screw 90 and move shutter 88. A shutter locating switch 94 defines a predetermined home or park position for shutter 88 which in the example shown, comprises the shutter closed position.

Figure 8:
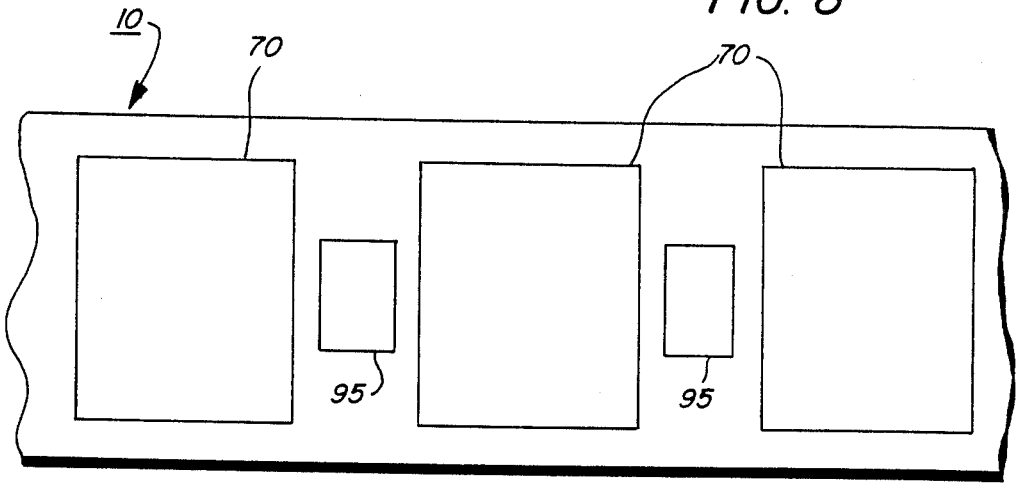
FIG. 8 is an enlarged schematic view showing a segment of the machine photoconductive belt illustrating the relation between copy images and test images.
Figure 10:
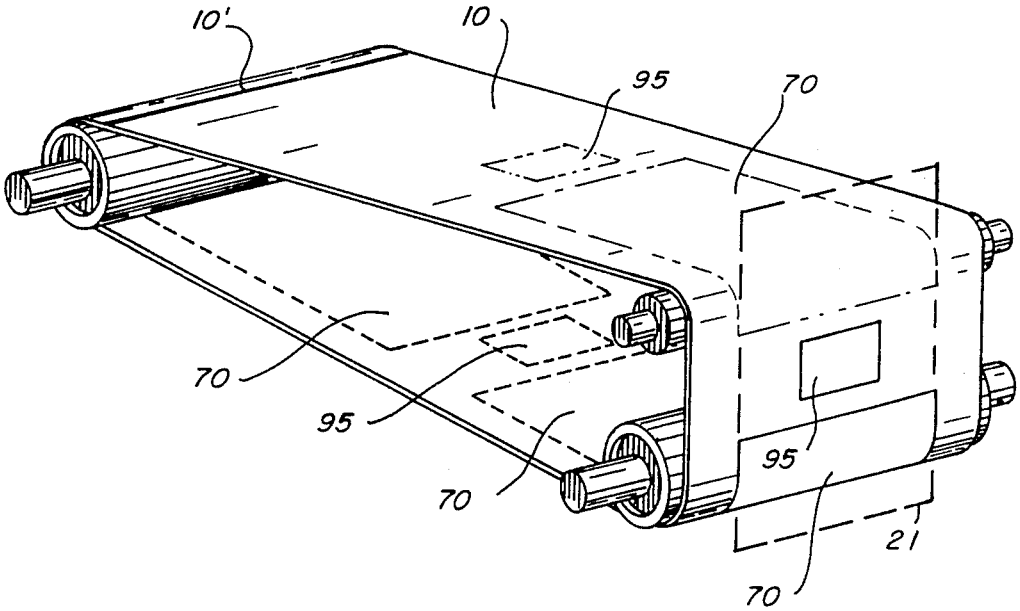
FIG. 10 is an isometric view illustrating details of the test patch transfer operation enabled during the servicing routine.

Referring to FIGS. 2, 8 and 10, in order to monitor the effectiveness of certain ones of the xerographic processing components such as corona charging device 14, mag brush rollers 26, 28, etc., a test patch or image 95 is created from time to time in the interdocument area 78 of photoconductive belt 10. For this purpose, a suitable exposure device such as a Light Emitting Diode (LED) 96 is provided opposite belt 10 downstream of exposure station B. LED 96, when energized, exposes the previously charged belt 10 in the interdocument area 78 thereby creating the test image 95. Following exposure, the test image is developed by mag brush rollers 26, 28, and the image density checked. In one example an infra-red densitometer 115 is positioned between developer station C and transfer station D, densitometer 115 generating electrical signals proportional to the developed toner mass of the test image 95. Where test images are being generated for analysis, the operation timing of the interdocument erase lamp 80 is changed to avoid erasing the image 95.

To aid the Tech Rep in diagnosing and servicing reproduction machine 5, a plurality of diagnostic programs (shown in Tables V–X) may be summoned through the expediency of coded numbers input through keyboard 100 of control panel 6 on entry into a Service Mode. Typically, the Service Mode is entered by the Tech Rep by means of a special key, or coded number known to the Tech Rep.

For example, where numerical coding is used, a certain diagnostic program stored in NVM 61 may bear the code number "×23". The Tech Rep, on entering the Service Mode, uses the keyboard 100 to enter the code number "×23" which is displayed on numeric display 104 of control panel 8 as entered by the Tech Rep.

One series diagnostic programs that may be entered by the Tech Rep are programs for displaying the time required for a copy sheet 21 to travel from one jam detection station to the next (Tables V, VI). In these diagnostic programs, the information is displayed on numerical display 104 of control panel 6 in clock counts which may then be compared by the Tech Rep with a reference clock span or clock window reflecting the accepted time interval. If the displayed clock count is not within the clock window, adjustment, or repair or replacement of the related machine components are made to bring the time interval into the acceptable limit.

As will appear more fully herein, where for example the Tech Rep wants to determine the time interval required for a copy sheet 21 to traverse from pretransfer jam detection station 49 to the fuser jam detection station 51, the Tech Rep keys in the appropriate program number (i.e. "×23") using the keyboard 100. The Tech Rep then actuates start/print button 105 on control panel 6 to actuate reproduction machine 5 and feed a copy paper forward from the paper tray 27 or 27' selected.

Figures 5, 9:
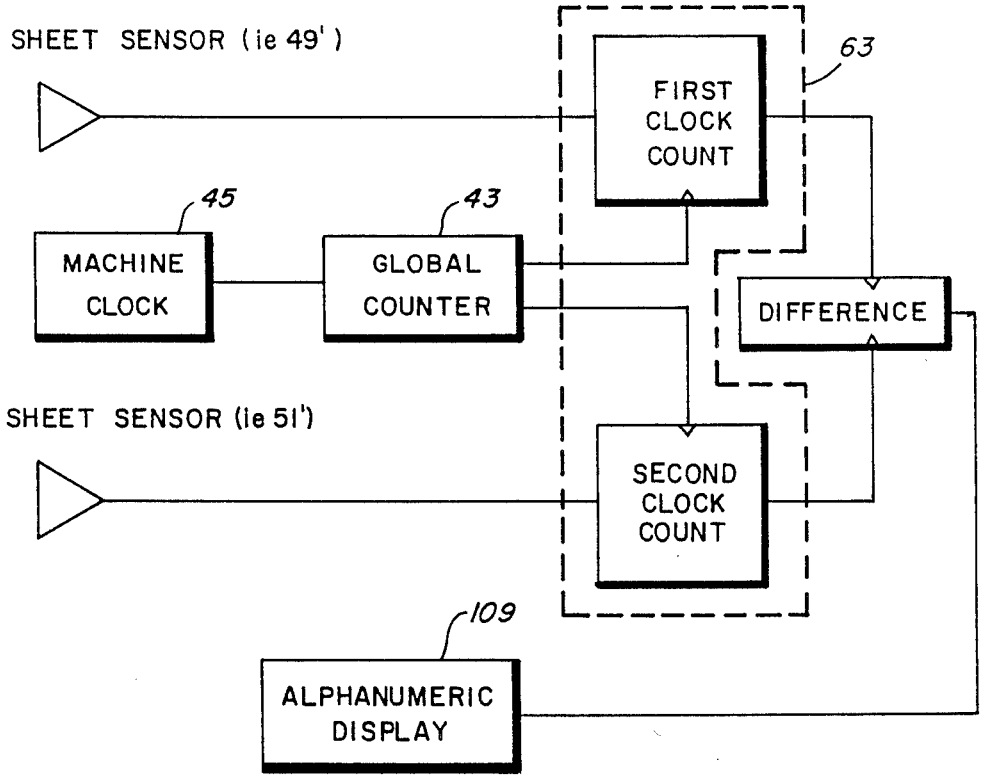
FIG. 5 is a view of the copy information byte for providing control instructions to the copy processing components on a step by step basis as each copy sheet progresses along the paper path shown in FIG. 3.
FIG. 9 is a flow chart showing the operating sequence for determining machine timing.

As shown in FIG. 9 where for example the Tech Rep has keyed in the aforementioned routine for determining the time interval required for a copy sheet to travel from pretransfer jam detection station 49, identified by sensor 49' on sensing the leading edge of the copy sheet, to the prefuser jam detection station 51, identified by sensor 51' in response to detection of the leading edge of the copy sheet, the clock count on global counter 43 is read into RAM memory 63 in response to the leading edge of the copy sheet reaching jam detection sensor 49'. Subsequently, when the copy sheet leading edge is sensed by sensor 51' of prefuser jam detection station 51, the clock count on counter 43 is read into RAM memory 63. The counts are then differenced and the result, which is representative of the time required for the copy sheet to pass from pretransfer jam detection station 49 to prefuser jam detection station 51 displayed on numeric display 104 of control panel 6. The displayed number is then compared by the Tech Rep with the clock window for that particular portion of the copy sheet path to see if the number falls within the window. If not, adjustments/repairs/replacements are made to the affected components to bring the time interval within the desired operating time interval.

In a similar manner, the time required for a copy sheet to pass between selected points in reproduction machine 5 including the other jam detection stations and other points along the paper path and within any output module, i.e. SOR 9, as well as the time required for documents 16 to pass between selected points in the input module, i.e. RDHR 17, may be determined and compared with the specific clock window therefor by the Tech Rep keying in the diagnostic code number on control panel 6 and starting the machine 5.

In addition, routines (Tables I–IV, XI) are provided to enable the Tech Rep to change or adjust, either permanently, or temporarily while servicing the machine, the operating parameters of various machine components. During this process, the machine 5 is automatically programmed to operate through a predetermined copying cycle to permit the Tech Rep to view the effect of any change made on the copy output of the machine. This additionally permits the Tech Rep to observe the interplay between changes in operating parameter of one component on other components immediately so that compensating adjustments in the operating parameters of any related components can be made and observed.

In this connection, routines are provided to enable the Tech Rep to change the operational timing of the exposure means, i.e. flash lamp 20, the on/off timing of patch generator 96, the on/off timing of the non-image erase means, i.e. interdocument fadeout lamp 80, the operating locations of edge fadeout shutter 88, and adjustment for the belt seam 10'. Routines for changing other machine operating parameters may be readily envisioned. Inasmuch as the operating parameters for the aforementioned components are, when once set, constant, the individual parameters are stored in NVM 61.

To provide access to NVM 61, and the operating parameters stored therein, certain combinations of numbers address or access the particular location in NVM 61 (i.e. Tables XIII, XIV) for the various machine operating parameters such as those described above. Using keyboard 100 of control panel 6, the Tech Rep enters the appropriate code for the operating parameter to be looked at, which when addressed is displayed on numeric display 104. Following fetching of the desired operating parameter, the Tech Rep pushes Start/Print button 105 to operate reproduction machine 5, the machine automatically being programmed by the diagnostic routine or class of routines being run to operate through a predetermined copy cycle, i.e. a 5 copy run.

As the reproduction machine 5 operates, the Tech Rep views the copies as they are produced. Where a change in the operating parameter currently brought up is desired, predetermined ones of the selection buttons on keyboard 100 may be actuated to selectively increment or decrement the current operating parameter. This may be done while reproduction machine 5 makes copies to enble the Tech Rep to continuously examine and appraise the effect of the changes in the parameter on the copy output of machine 5.

As described, one or more test images or patches 95 are generated from time to time, the test image or images being read by densitometer 115 to determine the operating effectiveness of various components of MIR 13 and XER 15. Since the test images rest within the interdocument area 78, these images do not appear on the copies produced by machine 5.

A routine (Table XII) is provided to enable the Tech Rep to view the test images 95 to determine if the test images are being generated and developed properly, the routine in effect changing the timing at which copy sheets are fed to transfer station C so that the test images appear on the copy sheet. For this routine, the Tech Rep using keyboard 100, programs in the access code for printing the test image 95. Following keying in of the access code, the Tech Rep depresses Start/Print button 105 to operate the machine and process a single copy. During the copy process, the selected routine delays timing of the feeding of the copy sheet to transfer station C by approximately one-half a cycle. While such a delay in feeding the copy sheet mis-registers the copy sheet relative to the normal image, the test image 95 in the interdocument area 78, which was previously developed by mag brush rolls 26, 28, is transferred to the copy sheet where it may be examined by the Tech Rep.

In this context, the interdocument erase lamp 80 is operated normally to discharge areas of belt 10 on each side of test image 95. And flash lamp 20 is also triggered normally even though no document is present on platen 18, the light from lamp 20 serving to expose the remaining nonimage areas of belt 10.

To facilitate servicing and trouble shooting of auxiliary modules such as RDHR 17, a routine is provided for exercising the reproduction machine 5 in the same manner as if copies were being made but without actually producing copies. At the same time, the auxiliary module being checked operates in a normal manner as if copies were being made, thereby permitting the Tech Rep to study and evaluate the auxiliary module's performance without actually running the basic machine.

For this routine, the Tech Rep keys in the appropriate access code via keyboard 100 on control panel 6. When fetched, the routine disables certain of the operating components of reproduction machine 5 including the paper feeders 62, interdocument erase lamp 80, flash lamp 20, and the drive connection between main drive motor 29 and mag brush rolls 26, 28 so that no copies will be produced. The machine main drive motor 29, belt 10, machine clock 45, and pitch reset signal generator 47 are operated in the normal manner.

The Tech Rep loads the documents into the RDHR 17 as if a copy run were to be made and depresses the Start/Print button 105. Upon startup, the RDHR 17 operates to feed one document at a time into registered position on platen 18 as if copies were being made while the reproduction machine is exercised as if copies were being processed. During the aforementioned psuedo operation, the Tech Rep checks operation of the RDHR for proper timing, jams, document mis-registering etc.

OPERATION

Figure 11:
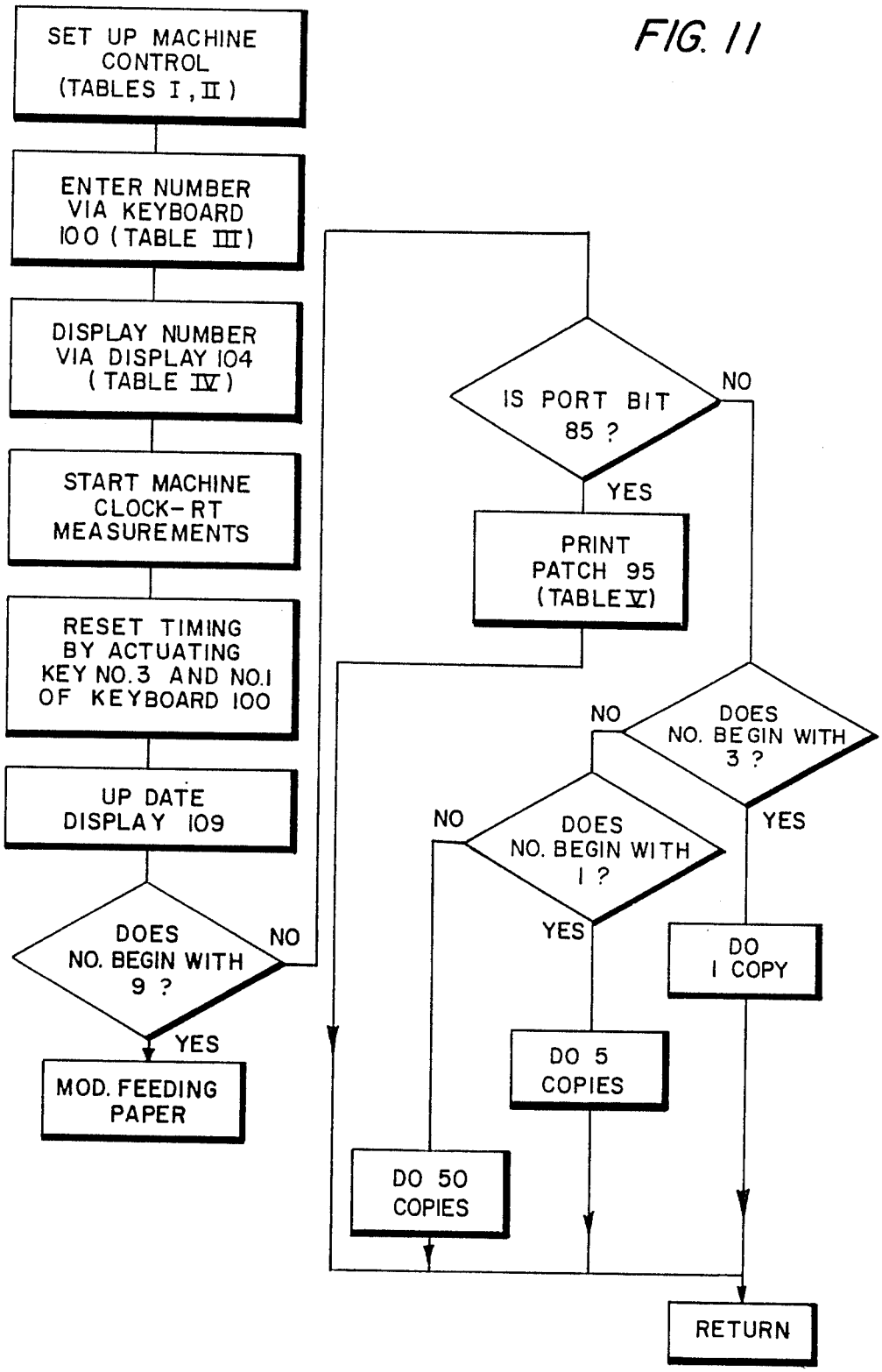
FIG. 11 is a flow chart depicting entry and programming of the machine timing routines and reproduction machine copy runs.

Referring particularly to FIG. 11, where the Tech Rep wishes to check and/or adjust machine 5, the Tech Rep enters, using keyboard 100, the identifying code number (i.e. "×23") for the particular machine operating/parameter to be checked (Tables I–III). As shown by the Machine Timing routine of Table I, the first digit ("×") of the code number chosen by the Tech Rep serves to pre-program the machine 5 to either make a copy run of a preset number of copies or no copies at all on subsequent actuation of Start/Print button 105 by the Tech Rep. With entry into the Machine Timing routine (Table I), the Set Up Machine Control routine (Table II) is entered to ready reproduction machine 5 for operation. Concurrently, the code number of the Machine Timing routine by the Tech Rep is displayed by the first 3 digits (left side) of numeric display 104 through the program routines of Tables III (SHIFT 3 DIGITS LEFT) and IV (DISPLAY NUMBERS ENTERED).

Where the first digit of the code number entered by the Tech Rep is not "9" (IF DIAGNOSTIC @ LEFT=9 . . . ELSE BEGIN; Table I) and the second two digits are less than 85 (IF PORT @ BIT<85), then if the first digit is "3", a copy run of 1 is pre-programmed, if the first digit is "1" (which is used for setting up or adjusting machine timing), a copy run of 5 is pre-programmed, and if the first digit is "9", no copies are produced. For all other first digit selections, a copy run of 50 is pre-programmed.

Figure 12:
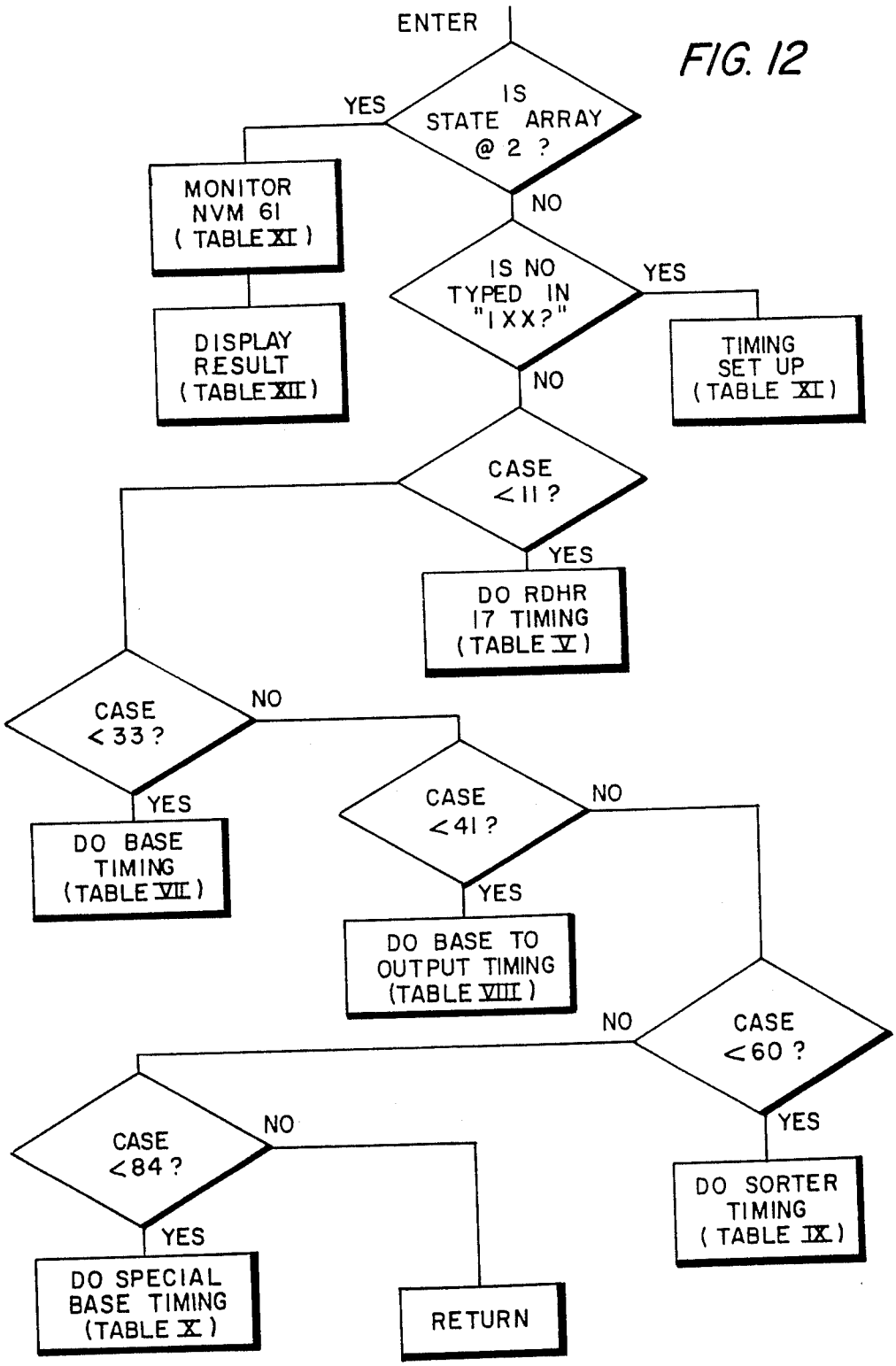
FIG. 12 is a flow chart depicting the servicing routine selection process.

Referring to FIG. 12 and the Machine Timing routine of Table V, where the reproduction machine 5 is at level 1 (STATE @ ARRAY [VIP] STATE≠LEVEL2) and the code number input by the Tech Rep is less than "11" (CASE<11), one of the RDH Timing routines (Table VI) is entered to provide the time interval required for a document to move through a selected portion of the document path 122 in RDHR 17. For example, where the code number is "×13", the time interval required for a document to move from the exit of platen 16 to the inlet of document tray 17' will be determined and displayed in clock counts on numeric display 104 upon actuation of Start/Print button 105.

Where the code number input by the Tech Rep is between "11" and "33" (CASE<33), the Base Timing routine of Table VII is entered. This routine identifies the time interval for a copy sheet to move through a selected portion of the paper path, with the time interval displayed as a clock count on numeric display 104. For example, if it were desired to determine the time interval required for a copy sheet to move from pre-transfer jam detection densor 49' to prefuser jam detection sensor 51', the code number "×23" is input via keyboard 100. In this connection, it is understood that the "×" digit is used to pre-program reproduction machine for a preset copy run.

Similarly, where the code number input by the Tech Rep is between "33" and "41" (CASE<41), or between "41" and "60" (CASE<60), or between "60" and "84" (CASE<84), the Base to Output Timing (Table VIII), or the Sorter Timing (Table IX), or the Special Base Timing (Table X) routine is entered.

Having selected the desired machine operating parameter to be checked by input of the requisite code number, the Tech Rep next actuates Start/Print button 105 to operate reproduction machine 5 through the preprogrammed copy run determined by the first digit ("×") of the code number as described. With operation of reproduction machine 5, the time interval for the specific machine portion selected is calculated by differencing the counts on global counter 43 (See FIG. 9) with the resulting count displayed in clock counts on numeric display 104 of control panel 6.

Where the Tech Rep desires to change or adjust the current operating parameter of the machine component or sub-assembly being examined which is held in NVM 61 (i.e. the operating locations of shutter 88), the Tech Rep inputs the requisite code number, the first digit of which is a "1". The Machine Timing routine (Table V) calls the Timing Set Up routine (Table XI). This routine enables the Tech Rep, by actuating in selective fashion, either the #3 or #1 digit of keyboard 100 to adjust the operating parameter in NVM 61, actuation digit #3 incrementing, in steps of 1, the selected parameter stored in NVM 61 while actuation of digit #1 decrements the selected parameter in steps of 1. During adjustment, the count which represents the operating parameter is continuously displayed on numeric display 104.

It will be understood that during adjustment of a particular operating parameter in NVM 61, reproduction machine 5 is pre-programmed to make a run of 5 copies. This permits the Tech Rep to observe the effect of the changes as they are being made on the copies.

Referring to FIG. 11, where the Tech Rep desires to visually observe test patch 95, the code number (i.e. "×85") for the Patch Printer (Table XII) is entered through keyboard 100. The Machine Timing routine (Table I), where the code number is "85" (IF PORT @ BIT<85, THEN), calls the Patch Print routine which offsets the operational timing of reproduction machine 5 by a predetermined degree (ADDED @ VALUE 255-FLASH @ 5 @ PITCH) such that on subsequent actuation of Start/Print button 105 and operation of reproduction machine 5, the test patch 95 is transferred to the copy sheet or sheets for examination by the Tech Rep as shown in FIG. 10.

Where the Tech Rep wishes to access NVM 61 to view a current operating parameter stored therein, job interrupt (VIP) button 108 on control panel 6 is actuated to switch reproduction machine 5 to a second operating level (IF STATE @ ARRAY=LEVEL 2, Table V) and bring up the routine Monitor NVM of Table XIII. The Tech Rep inputs the requisite identifying code number for the memory location desired through keyboard 100 and the routine Display Result of Table XIV is called to display the selected parameter in NVM 61 on numeric display 104.

While the invention has been described with reference to the structure disclosed, it is not confined to the details set forth, but is intended to cover such modifications or changes as may come within the scope of the following claims.

| LEGEND FOR TABLES I-XIV | |
|---|---|
| = | Equal |
| != | Not equal |
| PORT@BIT | Number entered by Tech Rep |
| FLT | Fault |

-continued

| LEGEND FOR TABLES I-XIV | |
|---|---|
| BPASS | Bypass |
| DIAG | Diagnose |
| PROC | Process |
| CTRL | Control |
| PWR | Power |
| CONVER | Conversion |
| ID | Identification |
| DSP | Display |
| ZBIN | To binary |
| MC | Machine Clock (#45) |
| RT | Real time |
| TYPE IN NUMBER | Insert program number via keyboard 100 |
| TEMP DEVICE | Identifies SW to be reused |
| JO@CONFIG & INPMASK | Refers to machine configuration identification, i.e. if Not = to 0, then machine includes RDHR 21. |
| PHR | #11 |
| MIR | #13 |
| DIFF | Difference |
| SKIP@DISPLAY | Omit display |
| GLOBAL CLOCK | #43 |
| SHUTTER | #88 |
| NVM | #61 |
| KEYBD | Keyboard 100 |
| CNV2B-2DSP | Convert 2 byte to display format |
| VIPSTATE | Interrupt state |

TABLE I

DC26
MACHINE TIMING

DESCRIPTION:
THIS IS THE CONTROLL ROUTINE FOR DC26 :
MACHINE TIMING SET UP AND DISPLAY.
DEPENDING ON THE NUMBER ENTERED, THIS ROUTINE WILL PROGRAM FOR 1 COPY RUN, 5 COPIES RUN, OR 50 COPIES RUN 1 COPY RUN FOR ANY NUMBER BEGIN WITH 3XX 5 COPIES RUN FOR ALL MACHINE TIMING SET UP BEGIN WITH 1XX 0 COPY (INHIBIT FEED) FOR ALL NUMBERS BEGIN WITH 9XX 50 COPIES RUN OTHERWISE.
FOR MACHINE TIMING SET UP THE KEY BOARD NUMBER 3 AND 1 ARE MONITORED, 3 TO INCREMENT BY 1 IN THE NVM LOCATION & 1 TO DECREMENT BY 1 THE DISPLAYED NVM LOCATION IN 1 COPY RUN FOR MACHINE TIMING MEASUREMENT, IF THE DESTINATION SWITCH IS NOT MADE WITHIN 6 SECOND, A LETTER E WILL BE FLASHING.
ALL NUMBERS CAN BE CHANGED DURING RUN OR STANBY.
ALL COPY-RUN MODE CAN ONLY CHANGE IN STANDBY MODE

```
LOCAL PROCEDURE MACHINE_TIMING;
ENTER;
PATCH@PRINTER ← CLEAR;
SET_UP_MACHINE_CONTROLL;
DISP LOOP FOREVER;
SHIFT_3DIGITS_LEFT;
DISPLAY_NUMBERS_ENTER;
TIMING@VALUE ← 0;
CONTR LOOP FOREVER;
IF STATE@ARRAY(MACHINESTATE) != PRINTSTATE
THEN BEGIN;
IF STATE@ARRAY(VIPSTATE) != LEVEL2 THEN
BEGIN:
IF DIAGNOSTIC@LEFT(3) = 9 THEN
BEGIN;
DIAG@SETUP@INHIBITS ← "FC";
PROC@CTRL@SWITCH ← 1;
END;
ELSE BEGIN;
DIAG@SETUP@INHIBITS ← 0;
IF PORT@BIT < 85 THEN
PROC@CTRL@SWITCH ← PROCESS@FLAG &
                    NOPWRCONVER;
IF (PORT@BIT = 85) & (PATCH@PRINTER = CLEAR)
THEN BEGIN;
```

TABLE I-continued

```
PATCH_PRINTER;
PATCH@PRINTER ← SET;
END;
END;
IF DIAGNOSTIC@LEFT(3) < 3 THEN
BEGIN;
IF DIAGNOSTIC@LEFT(3) = 2 THEN
QUANTITY@SELECTED ← 1;
ELSE QUANTITY@SELECTED ← 5;
END;
ELSE BEGIN;
IF PORT@BIT > 85 THEN QUANTITY@SELECTED ← 1;
ELSE QUANTITY@SELECTED ← 50;
END;
END;
ELSE BEGIN;
DIAG@SETUP@INHIBITS ← 0;
QUANTITY@SELECTED ← 50;
PROC@CTRL@SWITCH ← PROCESS@FLAG &
                    NOPWRCONVER;
END;
END;
RACE;
CASE NEXTIME KEYBD#CL = PUSHED;
CANCEL MC_RT_MEASUREMENTS;
IF ((STATE@ARRAY(MACHINESTATE) != PRINTSTATE)
(PROC@CTRL@SWITCH != 1)) THEN
PROC@CTRL@SWITCH ← PROCESS@FLAG &
                    NOPWRCONVER;
EXIT CONTR;
CASE NEXTIME KEYBD#3 = PUSHED;
TIMING@VALUE ← 1;
CASE NEXTIME KEYBD#1 = PUSHED;
TIMING@VALUE ← MINUSONE;
CASE NEXTIME KEYBD#0 = PUSHED;
DIAGNOSTIC_PRINTER;
CASE 5 SEC;
IF DIAGNOSTIC@LEFT(3) = 2 THEN
BEGIN;
IF SWITCH@COUNT = 1 THEN
BEGIN;
MONITOR@FLAG ← CLEAR;
WAIT 5 SEC;
IF MONITOR@FLAG = CLEAR THEN
BEGIN;
DIAGNOSTIC@RIGHT ← BLANK;
DIAGNOSTIC@RIGHT(0) ← ALPHAE;
START UPDATE_DISPLAY(TECHREPRIGHT,BLINKRATE);
END;
END;
END;
END;
RELOOP CONTR;
RELOOP DISP;
RETURN;
END;
```

TABLE II

BEGINNING FOR DC26
SET UP MACHINE CONTROLL

```
DESCRIPTION:
THIS IS AN INTERFACE PROCEDURE BETWEEN APPS
AND DIAG. FOR THE PROCEDURES IN DIAGNOSTIC
WHICH REQUIRED TO FEED PAPER.
THIS PROCEDURE PASS ALL MACHINE CONTROLL
```

TABLE II-continued

```
BACK TO APPS. LIKE NORMAL RUN
CALLED BY:
DC26,DC29,DC28
LOCAL PROCEDURE SET_UP_MACHINE_CONTROLL:
ENTER:
DIAG@FLT@BPASS,DIAG@SETUP@INHIBITS ← 0;
START FAULT_MANAGER (0,0,6);
PROC@CTRL@SWITCH ← PROC@CTRL@SWITCH &
                    NOPWRCONVER;
CANCEL MONITOR_INTERLOCKS;
START MONITOR_INTERLOCKS;
START CONSOLE_INPUT;
RETURN;
END;
```

TABLE III

SHIFT 3DIGITS LEFT

```
DESCRIPTION:
THIS ROUTINE IS ASKING FOR THREE NUMBERS TO BE
ENTER BY THE TECH REP. THESE THREE NUMBERS
WILL BE STORED IN DIAGNOSTIC@LEFT ARRAY FOR
DISPLAYING IN THE LEFT LATER
CALLED BY:
DC26
LOCAL PROCEDURE SHIFT_3DIGITS_LEFT:
ENTER:
DIAGNOSTIC_ID_DISPLAY (DIGIT3);
DIAGNOSTIC@LEFT(1) ← KEYBOARD@DIS-
                    PLAY@ARRAY(0);
DIAGNOSTIC@LEFT(2) ← KEYBOARD@DIS-
                    PLAY@ARRAY(1);
DIAGNOSTIC@LEFT(3) ← KEYBOARD@DIS-
                    PLAY@ARRAY(2);
KEYBOARD@DISPLAY@ARRAY(2) ← 0;
RETURN;
END;
```

TABLE IV

DISPLAY NUMBERS ENTER

```
DESCRIPTION:
THIS ROUTINE WILL TAKE THE NUMBER ENTERED BY
THE TECH REP AND DISPLAY IT IN THE LEFT
CONTROLL CONSOLE. THE RIGHT DISPLAY WILL
BE BLANK.
THE NUMBER ENTERED WILL BE USED AS POINTER
LATER AND 50 COPIES RUN WILL BE ASSIGNED
AUTOMATICALLY.
CALLED BY:
DC26,DC29,DC40,DC28
LOCAL PROCEDURE DISPLAY_NUMBERS_ENTER:
ENTER:
DIAGNOSTIC@LEFT(0) ← BLANK;
DIAGNOSTIC@RIGHT ← BLANK;
CNV_DSP2BIN (KEYBOARD@DISPLAY@ARRAY) RE-
TURNS RESULT@WORD;
PORT@BIT ← LSB(RESULT@WORD) - 10;
START UPDATE_DISPLAY (TECHREPRIGHT,NONBLINK);
START UPDATE_DISPLAY (TECHREPLEFT,NONBLINK);
START MC_RT_MEASUREMENTS (0);
RETURN;
END;
```

TABLE V

DC26
MACHINE TIMING

```
DESCRIPTION:  THE PURPOSE OF THIS ROUTINE IS TO AID THE TECH REP IN
              MACHINE TIMING SET UP AND ALSO TO DISPLAY THE TIMING
              BETWEEN TWO SWITCHES OR SENSORS IN THE MACHINE.
              THE VALID NUMBERS FOR THIS ROUTINE ARE:
                          FOR MACHINE TIMING SET UP
              115    FLASH TIMING SET UP
              116    PATCH GENERATOR ON TIME SET UP
              117    PITCH FADEOUT LEAD EDGE SET UP
```

TABLE V-continued

| | | | | |
|---|---|---|---|---|
| 118 | PATCH GENERATOR OFF TIME SET UP | | | |
| 119 | PITCH FADEOUT TRAIL EDGE SET UP | | | |
| 120 | FLASH TIMING SET UP FOR FOUR PITCH MODE | | | |
| 121 | PATCH GENERATOR ON TIME SET UP FOR 4 PITCH MODE | | | |
| 122 | PITCH FADEOUT LEAD EDGE SET UP FOR 4 PITCH MODE | | | |
| 123 | PATCH GENERATOR OFF TIME SET UP FOR 4 PITCH MODE | | | |
| 124 | PITCH FADEOUT TRAIL EDGE SET UP FOR 4 PITCH MODE | | | |
| 125 | EDGE FADEOUT SHUTTER SET UP | | | |
| 132&3 | BELT SEAM SET UP FOR 5 PITCH MODE | | | |
| 134&5 | BELT SEAM SET UP FOR 4 PITCH MODE | | | |
| | FOR MACHINE TIMING MEASUREMENTS | | | |
| | RDH TIMING | | | |
| X00 | PLAT#ENT | ACTUATION | TO CAM#POS | ACTUATION |
| X01 | CAM#POS | ACTUATION | TO CAM#POS | DEACTUATION |
| X02 | CAM#POS | DEACTUATION | TO PLAT#XIT | ACTUATION |
| X03 | PLAT#XIT | ACTUATION | TO TRAY#ENT | ACTUATION |
| X04 | TRAY#ENT | ACTUATION | TO TRAY#ENT | DEACTUATION |
| X06 | TRAY#XIT | ACTUATION | TO PLAT#ENT | ACTUATION |
| X07 | PLAT#ENT | ACTUATION | TO PLAT#ENT | DEACTUATION |
| X09 | TRAY#XIT | ACTUATION | TO TRAY#XIT | DEACTUATION |
| | BASE MACHINE TIMING | | | |
| X11 | DUP$FEED$CL | ON | TO DUP#WT | DEACTUATION |
| X13 | MAIN$TAR$CL | ON | TO MAIN#WT | DEACTUATION |
| X15 | AUX$TAR$CL | ON | TO AUX#WT | DEACTUATION |
| X17 | DUP#WT | DEACTUATION | TO PRE#XFER | DEACTUATION |
| X19 | MAIN#WT | DEACTUATION | TO PRE#XFER | DEACTUATION |
| X21 | AUX#WT | DEACTUATION | TO PRE#XFER | DEACTUATION |
| X23 | PRE#XFER | ACTUATION | TO PRE#FUS | ACTUATION |
| X24 | PRE#FUS | ACTUATION | TO PRE#FUS | DEACTUATION |
| X26 | PRE#FUS | ACTUATION | TO POST#FUS | ACTUATION |
| X27 | POST#FUS | ACTUATION | TO POST#FUS | DEACTUATION |
| X29 | POST#FUS | ACTUATION | TO COPY#OUT | ACTUATION |
| X30 | COPY#OUT | ACTUATION | TO COPY#OUT | DEACTUATION |
| X31 | COPY#OUT | DEACTUATION | TO BYPASS#T | DEACTUATION |
| | BASE TO OUTPUT TIMING (IN REAL TIME) | | | |
| X33 | BYPASS#T | ACTUATION | TO SOR1#INSW | ACTUATION |
| X34 | BYPASS#T | ACTUATION | TO SOR2#INSW | ACTUATION |
| X35 | BYPASS#T | ACTUATION | TO STTCH#IN | ACTUATION |
| X36 | BYPASS#T | ACTUATION | TO STACK#IN | ACTUATION |
| X38 | HOME#POS | ACTUATION | TO HOME#POS | DEACTUATION |
| X39 | HOME#POS | DEACTUATION | TO WIRE#FEED | ACTUATION |
| | SORTER TIMING | | | |
| X41 | TO X80 SOR#IN DEACTUATION TO BIN#ENT | | | DEACTUATION |
| | SPECIAL BASE TIMING | | | |
| X81 | NUMBER OF MACHINE CLOCK PER PITCH RESET | | | |
| X82 | NUMBER OF MACHINE CLOCK PER BELT HOLE | | | |
| X83 | NUMBER OF MACHINE CLOCK PER SECOND | | | |
| X84 | SET UP THE INVERTER GATE | | | |
| X85 | PATCH PRINTER | | | |
| | OTHERWISE | | | |
| X- | CLEAN BELT UPDATE CYCLE | | | |

```
WHERE X  = ANY NUMBER GREATER THAN 1
      -  = ANY NUMBER GREATER THAN 85
OTHERWISE
TIME BEGIN:
SKIP@DISPLAY,SWITCH@COUNT,LSB(TIME@DIFF),MSR(TIME@DIFF) ← 0;
PORT@BIT ← PORT@BIT + 10:
IF STATE@ARRAY(VIPSTATE) = LEVEL2 THEN MONITOR_NVM;
DISP LOOP FOREVER;
TYPEIN@NUMBER ← PORT@BIT;
IF DIAGNOSTIC@LEFT(3) = 1 THEN
BEGIN;
IF (PORT@BIT- 15<11)   (PORT@BIT - 32 < 4) THEN TIMING_SETUP;
ELSE RETURN;
END;
ELSE BEGIN;
TEST PORT@BIT;
CASE < 81;
LOOP SWITCH@COUNT ← 0 TO 1;
IF TYPEIN@NUMBER < 41 THEN
BEGIN;
TEMP@DEVICE ← BYTE@TB(TYPEIN@NUMBER);
SENSE@ ← BITSEN@TB(TYPEIN@NUMBER);
END;
TEST TYPEIN@NUMBER ;
CASE < 11;
IF (TO@CONFIG & INPMASK) != 0 THEN RDH_TIMING;
ELSE RETURN;
CASE < 33;
BASE_TIMING;
CASE < 41;
```

TABLE V-continued

```
CONTROL@ ← OUTPUT@MASK (PORT@BIT - 33):
IF (TO@CONFIG & CONTROL@) = 0 THEN RETURN;
ELSE BASE_TO_OUTPUT_TIMING;
OTHERWISE BEGIN:
IF PORT@BIT > 60 THEN
BEGIN:
IF (IO@CONFIG & SOR2MASK) = 0 THEN RETURN;
END;
ELSE IF (IO@CONFIG&SOR1MASK) = 0 THEN RETURN;
IF STATE@ARRAY(MACHINESTATE) != PRINTSTATE THEN
BEGIN;
SELECT_FEATURE(OUTPUTSELECTION,UNCOLLATED);
START OUTPUT_INTERFACE(SORVARIABLE,CLEAR);
START OUTPUT_INTERFACE(MACHINETIMING,PORT@BIT-40);
END;
SORTER_TIMING;
END;
END;
IF SWITCH@COUNT = 0 THEN STOP@TIMER ← TIME@DIFF;
ELSE TIME@DIFF ← TIME@DIFF - STOP@TIMER;
TYPEIN@NUMBER ← TYPEIN@NUMBER + 1;
RELOOP;
CASE < 84;
SPECIAL_BASE_TIMING;
CASE = 84;
INVERTER@GATE,SKIP@DISPLAY ← FIRSTSKIP;
CASE = 85;
LSB(TIME@DIFF) ← ADDED@VALUE;
OTHERWISE BEGIN;
IF DIAGNOSTIC@LEFT(3) = 9 THEN RETURN;
LSB(TIME@DIFF),PROC#CTRL@SWITCH ← 129;
IF SKIP@DISPLAY = 0 THEN
BEGIN;
CLEAN@BLT@CNTR ← 0;
DELAY#DEADCYCLE ← 1;
WAIT 250 MS;
START SELECT_FEATURE(4,1);
WAIT 1 PR 0;
START REQUEST_DEADCYCLE(XEROGRAPHICSSTATE,50);
END;
ELSE RETURN;
END;
END;
END;
IF SKIP@DISPLAY != FIRSTSKIP THEN DISPLAY_RESULT;
SKIP@DISPLAY,MONITOR@FLAG ← NOTFIRST;
RELOOP DISP;
END TIME;
END;
END;
```

TABLE VI

RDH TIMING

DESCRIPTION: THIS ROUTINE IS USED BY DC28 (RDH EXERCISER) AND DC26 (MACHINE TIMING) PROGRAM.
THIS ROUTINE IS MEASURED THE TIMING BETWEEN TWO SWITCHES OR SENSORS IN THE RDH AND DISPLAYED TO THE CONTROL PANNEL.
VALID NUMBERS FOR THIS ROUTINE ARE:

| | | | |
|---|---|---|---|
| X10 | PLAT#ENT | ACTUATION TO CAM#POS | ACTUATION |
| X12 | CAM#POS | DEACTUATION TO PLAT#XIT | ACTUATION |
| X13 | PLAT#XIT | ACTUATION TO TRAY#ENT | ACTUATION |
| X14 | TRAY#ENT | ACTUATION TO TRAY#ENT | DEACTUATION |
| X16 | TRAY#XIT | ACTUATION TO PLAT#ENT | ACTUATION |
| X17 | PLAT#ENT | ACTUATION TO PLAT#ENT | DEACTUATION |
| X19 | TRAY#XIT | ACTUATION TO TRAY#XIT | DEACTUATION |

```
LOCAL PROCEDURE RDH_TIMING;
ENTER;
IF (TO@CONFIG & RDHMASK) = 0 THEN
BEGIN;
IF TYPEIN@NUMBER > 5 THEN TEMP@DEVICE ← TEMP@DEVICE + 1;
IF TYPEIN@NUMBER = 6 THEN SENSE@ ← BITOSENSE0;
END;
OPTIMIZE 1;
INPUT_RT_COUNT(TEMP@DEVICE,SENSER) RETURNS LSB(TIME@DIFF),MSR(TIME@DIFF);
OPTIMIZE 3;
TIME@DIFF ← TIME@DIFF + TIME@DIFF;
IF (TO@CONFIG & RDHMASK) = 0 THEN;
BEGIN;
```

TABLE VI-continued

```
IF (PORT@BIT = 5) × (S@FIG#6COUNT = 1) THEN OMIT 1 SEC;
END;
RETURN;
END;
```

TABLE VII

BASE TIMING

```
DESCRIPTION:
THE PURPOSE OF THIS ROUTINE IS TO MEASURED
AND DISPLAYED THE TIMING BETWEEN TWO
SWITCHES OR SENSORS OF THE BASE MACHINE.
THIS ROUTINE WILL RECORDED THE TIME WHEN
THE SWITCH IS TOGGLE, AND THE DISTANCE WILL
BE COMPUTED BY MAIN ROUTINE AND DISPLAYED
IN CONTROL PANNEL.
THE ROUTINE DELAY WILL BE:
2400 MC FOR TIMING FROM DUP#WT TO PRE#XFER
2000 MC FOR TIMING FROM MAIN#WT TO PRE#XFER
1660 MC FOR TIMING FROM AUX#WT TO PRE#XFER
600 MC FOR TIMING FROM PRE#FUS TO POST#FUS
600 MC FOR TIMING FROM POST#FUS TO COPY#OUT
MOD@FEED@TM MC FOR MODIFIED FEED NUMBER
```

```
LOCAL PROCEDURE BASE_TIMING;
ENTER;
IF SENSE@ = PHRINPUT THEN
PHR_DIGITAL_MC(TEMP@DEVICE) RETURNS
MSR(TIME@DIFF),LSB(TIME@DIFF);
ELSE MIR_DIGITAL_MC(TEMP@DEVICE) RETURNS
MSB(TIME@DIFF),LSB(TIME@DIFF);
IF SWITCH@COUNT = 0 THEN
BEGIN;
IF (PORT@BIT = 17) THEN WAIT 2400 MC;
IF (PORT@BIT = 21) THEN WAIT 1660 MC;
IF (PORT@BIT = 26)   (PORT@BIT = 29) THEN
WAIT 600 MC;
IF (PORT@BIT = 11) < 6 THEN
BEGIN;
TIME@DIFF ← TIME@DIFF + RHD@FEED@TR;
IF SKIP@DISPLAY = 0 THEN
SKIP@DISPLAY ← FIRSTSKIP;
WAIT MOD@FEED@TM MC;
END;
IF PORT@BIT = 10 THEN WAIT 2000 MC;
END;
ELSE IF PORT@BIT = 15 THEN WAIT 100 MC;
```

TABLE VIII

BASE TO OUTPUT TIMING

```
DESCRIPTION:
THE PURPOSE OF THIS ROUTINE IS TO MEASURE THE
TIMING FROM BYPASS TRANSPORT SWITCH OF BASE
MACHINE TO OUTPUT REMOTES SWITCHES (SORTER
INPUT SWITCH, STITCHER OR STACKER INPUT SWITCH).
THE TIMING IN THIS ROUTINE WILL BE MADE IN
REAL TIME
```

```
LOCAL PROCEDURE BASE_TO_OUTPUT_TIMING;
ENTER;
IF PORT@BIT < 33 THEN RETURN;
OPTIMIZE 1;
IF (SWITCH@COUNT = 0) & (PORT@BIT < 38) THEN
BEGIN;
RACE;
CASE NEXTIME BYPASS#T = PAPER;
END;
END;
ELSE BEGIN;
IF PORT@BIT = 34 THEN WAIT 750 MS;
12SOR_2FINISH(TEMP@DEVICE,SENSER,255) RETURNS
LSB(TIME@DIFF),MSB(TIME@DIFF);
END;
READ_GLOBAL_CLOCK(REALTIME,TIME@DIFF);
OPTIMIZE 3;
RETURN;
END;
```

TABLE IX

SORTER TIMING

```
DESCRIPTION:
THE PURPOSE OF THIS ROUTINE IS TO MEASURE THE
TIMING FROM SORTER INPUT SWITCH TO ANY BIN
ENTER SENSOR.
THE TIMING IS DISPLAY IN REAL TIME
```

```
LOCAL PROCEDURE SORTER_TIMING;
ENTER;
IF PORT@BIT > 60 THEN TEMP@DEVICE ← BINENTER2;
ELSE TEMP@DEVICE ← BINENTER1;
TEMP@DEVICE ← TEMP@DEVICE   SWITCH@COUNT;
OPTIMIZE 1;
T2SOR_2FINISH (TEMP@DEVICE,0,255) RETURNS
LSB(TIME@DIFF),MSB(TIME@DIFF);
OPTIMIZE 3;
TIME@DIFF ← TIME@DIFF + TIME@DIFF;
RETURN;
END;
```

TABLE X

SPECIAL BASE TIMING

```
DESCRIPTION:
THIS ROUTINE IS USED TO MEASURE THE TIMING
FROM PITCH RESET TO PITCH RESET.BELT HOLE TO
BELT HOLE AND NUMBER OF MILLISECONDS PER
PITCH RESET
```

```
LOCAL PROCEDURE SPECIAL_BASE_TIMING;
ENTER;
TEST PORT@BIT;
CASE = 81;
PHR_DIGITAL_MC(PIT#RESET1) RETURNS
MSB(OUTPUT@VALUE),LSB(OUTPUT@VALUE);
CASE = 82;
PHR_DIGITAL_MC(BELT#H1) RETURNS
MSB(OUTPUT@VALUE),LSB(OUTPUT@VALUE);
OTHERWISE BEGIN;
WAIT 1 PR 0;
OUTPUT@VALUE ← RTC_AT_PITCH_RESET ;
END;
END;
TIME@DIFF ← OUTPUT@VALUE - STOP@TIMER;
STOP@TIMER ← OUTPUT@VALUE;
IF SKIP@DISPLAY = 0 THEN
SKIP@DISPLAY ← FIRSTSKIP;
RETURN;
END;
```

TABLE XI

TIMING SETUP

```
DESCRIPTION:
THE PURPOSE OF THIS ROUTINE IS TO AID THE TECH
REP IN SETTING UP THE MACHINE TIMING.
THE MACHINE TIMING CAN BE SET UP THROUGH THIS
ROUTINE ARE FLASH TIMING,PATCH GENERA-
TOR,PITCH FADEOUT,SHUTTER AND BELT SEAM.
THIS ROUTINE WILL DISPLAY THE CONTENT OF NVM
LOCATION FOR THESE TIMING. FIVE COPIES RUN
IS PROGRAM FOR THIS, AND NVM CAN BE CHANGE
BY PUSHING KEYBOARD NUMBER 3 AND 1.
```

```
LOCAL PROCEDURE TIMING_SETUP;
ENTER;
IF TIMING@VALUE != 0 THEN
BEGIN;
NVM@ARRAY1(PORT@BIT) ← NVM@AR-
                       RAY1(PORT@BIT) +
                       TIMING@VALUE;
IF PORT@BIT = 25 THEN
```

TABLE XI-continued

```
BEGIN;
CANCEL SHUTTER_RELAY;
START SHUTTER_RELAY(64);
END;
IF (PORT@BIT - 32) < 4 THEN PO@ERROR ← 0;
TIMING@VALUE ← 0;
END;
LSB(TIME@DIFF) ← NVM@ARRAY1(PORT@BIT);
RETURN;
END;
```

TABLE XII

PATCH PRINTER

```
DESCRIPTION:
THE PURPOSE OF THIS ROUTINE IS TO ADD FOR THE
TECH REP A TOOL TO PRINT OUT THE PATCHES IN
A NORMAL COPY RUN. PATCHES ARE PRINTING OUT
BY OFFSETTING THE FLASH TIMING, PATCH
GENERATOR, PITCH FADEOUT AND BELT SEAM
BY THE AMOUNT OF 255 - FLASH TIMING
(ASSUME THAT THE FLASH TIMING IS THE
BIGGEST NUMBER).
ALL MODES IN DC26 COULD BE USED FOR THIS,
AND THE PATCH PRINT OUT WILL BE:
COPY 1 : SEAM PATCH
COPY 2 : CLEAN BELT PATCH
COPY 3,4,5 : CURRENT PATCH
COPY 6 : SEAM PATCH
COPY 7 : TONER PATCH
COPY 8,9,10 : CURRENT PATCH
WHEN EXIT DC26, ALL ORIGINAL WILL BE RESTORED.
NOTE: IF MACHINE CRASH IN DC26, THESE NUMBER
MAY NOT BE RESTORED TO THE RIGHT VALUE.
```

```
LOCAL PROCEDURE PATCH_PRINTER;
ENTER;
IF PATCH@PRINTER = CLEAR THEN
ADDED@VALUE ← 255 - FLASH@5@PITCH;
ELSE ADDED@VALUE ← - ADDED@VALUE;
POWER@HP ← 0;
LOOP RANGE@INDEX ← 15 TO 19;
NVM@ARRAY1(RANGE@INDEX) ← NVM@AR-
RAY1(RANGE@INDEX) + ADDED@VALUE;
RELOOP;
LSB(FIVE@DELAY) ← LSB(FIVE@DE-
LAY) - ADDED@VALUE;
RETURN;
END;
```

TABLE XIII

MONITOR NVM

```
DESCRIPTION:
THIS ROUTINE IS USED TO DISPLAY NVM LOCATION
ENTER BY THE TECH. REP.
```

```
LOCAL PROCEDURE MONITOR_NVM;
ENTER;
MULTIPLY_WORD(0,DIAGNOSTIC@LEFT(3)-1,0,100) RE-
TURNS MSB(STOP@TIMER),
LSB(STOP@TIMER);
RACE;
CASE NEXTIME KEYBD#1 = PUSHED: CONTROL@ ← 1 ;
CASE NEXTIME KEYBD#2 = PUSHED: CONTROL@ ← 2 ;
CASE NEXTIME KEYBD#3 = PUSHED: CONTROL@ ← 3 ;
CASE NEXTIME KEYBD#4 = PUSHED: CONTROL@ ← 4 ;
CASE NEXTIME KEYBD#5 = PUSHED: CONTROL@ ← 5 ;
CASE NEXTIME KEYBD#6 = PUSHED: CONTROL@ ← 6 ;
CASE NEXTIME KEYBD#7 = PUSHED: CONTROL@ ← 7 ;
CASE NEXTIME KEYBD#8 = PUSHED: CONTROL@ ← 8 ;
CASE 4 SEC; CONTROL@ ←0 ;
END;
TEMP@1 ← MSB@PAGE(CONTROL@);
STOP@TIMER ← STOP@TIMER +
PACKWORD(TEMP@1,PORT@BIT);
LOOP FOREVER;
LOOPHOLE;
LHLD  STOP@TIMER
MDV  A,@
```

TABLE XIII-continued

```
STA  TIME@DIFF
END;
WAIT 200 MS;
DISPLAY_RESULT;
RELOOP;
RETURN;
END;
```

TABLE XIV

DISPLAY RESULT

```
DESCRIPTION:
THE PURPOSE OF THIS ROUTINE IS TO CONVERT A
BINARY WORD TIME@DIFF TO RCD FORMAT AND
DISPLAY THIS NUMBER TO THE CONTROL PANNEL.
FOR DC26, FOUR DIGITS NUMBER WILL BE
DISPLAYED. OTHERWISE 3 DIGITS NUMBER WILL
BE DISPLAYED.
```

```
LOCAL PROCEDURE DISPLAY_RESULT;
ENTER;
CNV2R_2DSP (TIME@DIFF) RETURNS TEMP@,
DIAGNOSTIC@RIGHT(3),DIAGNOSTIC@RIGHT(2),
DIAGNOSTIC@RIGHT(1),DIAGNOSTIC@RIGHT(0);
IF STATE@ARRAY(VIPSTATE)=LEVEL2 THEN
DIAGNOSTIC@RIGHT(3) ← CONTROL@;
START UPDATE_DISPLAY (TECHREPRIGHT,NONBLINK);
RETURN;
END;
```

I claim:

1. A method for adjusting the timing of the exposure lamp means in a reproduction machine to provide optimum copy quality, said machine including programming means for programming said machine for copy runs, display means for displaying the copy program, and memory means for storing the operating timing parameter of said exposure lamp means, comprising the steps of:

(a) using said programming means, inputting a preset machine servicing routine for accessing and displaying on said display means the current operating timing parameter for said exposure lamp means, said servicing routine automatically programming said machine to make a predetermined number of test copies;

(b) actuating said machine;

(c) viewing the test copies produced by said machine while adjusting the operating timing parameter for said exposure lamp means; and (d) repeating step c until the operating timing parameter for said exposure lamp means is adjusted so that said machine makes test copies having the desired copy quality.

2. The method according to claim 1 including the steps of:

(a) during said preset machine servicing routine and while said machine is making said test copies, addressing the location in said memory means where the current operating timing parameter for said exposure lamp means is stored; and (b) replacing the current operating timing parameter for said exposure lamp means with the adjusted timing parameter for said exposure lamp means in said memory means.

3. A method for timing the non-image erase means of a reproduction machine to provide optimum copy quality, said machine including programming means for programming said machine for copy runs, display means for displaying the copy program, and memory means for storing the operating timing parameter of said non-image erase means, comprising the steps of:

(a) using said programming means, inputting a preset machine servicing routine for accessing and displaying on said display means the current operating timing parameter for said non-image erase means, said servicing routine automatically programming said machine to make a predetermined number of test copies;

(b) actuating said machine;

(c) viewing the test copies produced by said machine while adjusting the operating timing parameter for said non-image erase means; and (d) repeating step c until the operating timing parameter for said non-image erase means is adjusted so that said machine makes test copies having the desired copy quality.

4. The method according to claim 3 including the steps of:

(a) during said preset machine servicing routine and while said machine is making said test copies, addressing the location in said memory means where the current operating timing parameter for said non-image erase means is stored; and (b) replacing the current operating timing parameter for said non-image erase means with; the adjusted timing parameter for said non-image erase means in said memory means.

5. A method for adjusting the location data for the edge fadeout shutter in a reproduction machine to provide optimum copy quality, said machine including programming means for programming said machine for copy runs, display means for displaying the copy program, and memory means for storing the location data for said edge fadeout shutter, comprising the steps of:

(a) using said programming means, inputting a preset machine servicing routine for accessing and displaying on said display means the current location data for said edge fadeout shutter, said servicing routine automatically programming said machine to make a predetermined number of test copies;

(b) actuating said machine;

(c) viewing the test copies produced by said machine while adjusting the location data for said edge fadeout shutter; and (d) repeating step c until the location data for said edge fadeout shutter is adjusted so that said machine makes test copies having the desired copy quality.

6. The method according to claim 5 including the steps of:

(a) during said preset machine servicing routine and while said machine is making said test copies, addressing the location in said memory means where the current location data for said edge fadeout shutter is stored; and (b) replacing the current location data for said edge fadeout shutter with the adjusted location data for said edge fadeout shutter in said memory means.

* * * * *